US005890594A

United States Patent [19]

Hansen et al.

[11] Patent Number: 5,890,594

[45] Date of Patent: Apr. 6, 1999

[54] PACKAGE WITH BUILT-IN MEASUREMENT DEVICE

[75] Inventors: Roger W. Hansen; James R. Ryan, both of Winona Lake, Ind.

[73] Assignee: DePuy Orthopaedics, Inc., Warsaw, Ind.

[21] Appl. No.: 885,066

[22] Filed: Jun. 30, 1997

[51] Int. Cl.[6] ..... B65D 77/04; B65D 73/00

[52] U.S. Cl. ..... 206/472; 206/470; 206/216

[58] Field of Search ..... 206/470, 472, 206/459.1, 216, 292; 242/160.1, 160.4

[56] References Cited

U.S. PATENT DOCUMENTS 1,567,991 12/1925 Clark .
2,110,123 3/1938 Eisele .
2,537,417 1/1951 Merske .
2,595,403 5/1952 Neuschaefer .
2,773,340 12/1956 McCarthy .
2,778,172 1/1957 Malley .
3,407,524 10/1968 Schladermundt et al. .
3,407,781 10/1968 Ardire et al. ..... 206/459.1
3,623,602 11/1971 Valente ..... 206/459.1
3,648,835 3/1972 Yucel .
4,770,299 9/1988 Parker .
5,129,516 7/1992 Theros ..... 206/470

*Primary Examiner*—Paul T. Sewell
*Assistant Examiner*—Anthony Stashick
*Attorney, Agent, or Firm*—Barnes & Thornburg

[57] ABSTRACT

A package is provided for a medical appliance. The package includes a container for the appliance and a measurement device that is carried by the container. The measurement device is accessible to a consumer and is formed to be extensible from and retractable into the container.

13 Claims, 3 Drawing Sheets

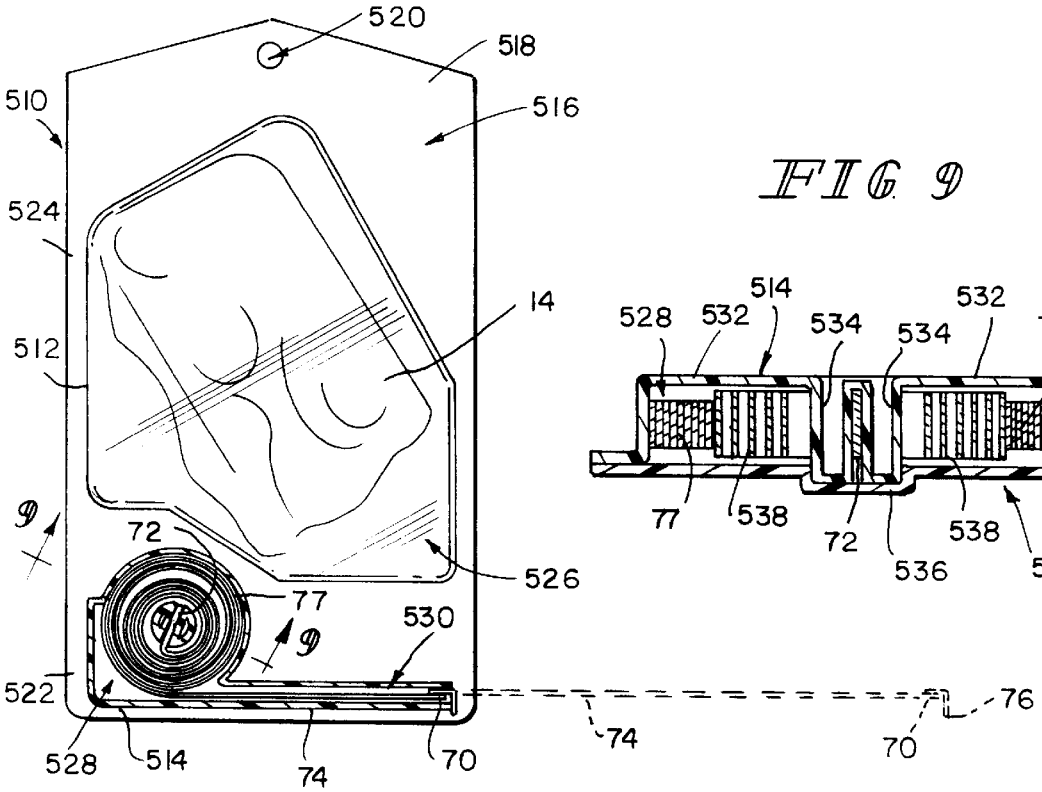
FIG. 8
FIG. 9
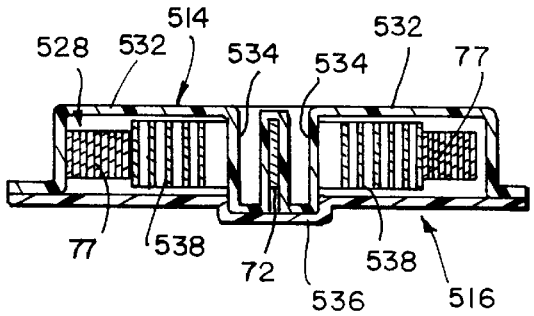

PACKAGE WITH BUILT-IN MEASUREMENT DEVICE

BACKGROUND AND SUMMARY OF THE INVENTION

This present invention is directed to a package for a sized appliance that permits a consumer to measure a body part and select a proper size of appliance, more particularly to a package for a medical appliance designed for use with a corresponding body part that has a container that holds the appliance and a measurement device carried by the container that is accessible to the consumer.

Many medical appliances sold into markets are proportioned in multiple sizes to accommodate consumers with different dimensions of body parts. To select the proper size of appliance, the customer must know an approximate size of the selected body part before purchasing the appliance. Consumers are often unsure or mistaken about the dimensions of their particular body parts. Therefore, when faced with selecting the appliance size, the customer either forgoes purchase of the appliance resulting in a lost or delayed sale or guesses as to the proper size which, if the choice is in error, results in dissatisfaction and/or the return of the purchased item.

Rather than guessing, many customers will open the package in the store to "try-on" the appliance. However, once a package is opened, the appliance is seldom returned to its proper factory-packaged appearance. Sloppy and half-opened packaging is undesirable to both the consumer and the retailer. What is needed is a package that permits a consumer to properly size a body part in question and to accurately select an appliance size without opening its package.

According to the present invention, a package is provided for a medical appliance that permits a consumer to measure a body part and to select a proper size of the medical appliance. The package comprises a container formed to enclose the medical appliance and a measurement device carried by the container. The measurement device has a first end accessible to the consumer, an opposite second end, and a center portion extending therebetween. A spring is also included to yieldably permit extension of the first end of the measurement device away from the container and to retract the first end toward the container following extension thereof.

According to another embodiment of the present invention, a method is provided for permitting a consumer to properly size a body part and to accurately select a corresponding appliance size without opening a package that holds the appliance. The method comprises the steps of inserting an appliance within a container formed to house the appliance and attaching to or disposing within the container a retractable measurement device. The measurement device has opposite ends and a center portion extending therebetween, the first end of the device being accessible to the consumer. The center portion of the measurement device carries mensuration indicia thereon.

Additional objects, features, and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

FIG. 8 is another alternative embodiment of the present invention illustrating a card affixed to a blister pack defining a chamber sized for holding a medical appliance, a spring-loaded tape measure having opposite ends, and a shrink-wrap wall affixed to the card and forming a housing for the tape measure and an outlet channel for extension of the tape therethrough; and FIG. 9 is a sectional view taken along lines 9—9 of FIG. 8 illustrating the positioning of spring-loaded tape measure between the shrink-wrap wall and the card.

DETAILED DESCRIPTION OF THE DRAWINGS

Figure 1:
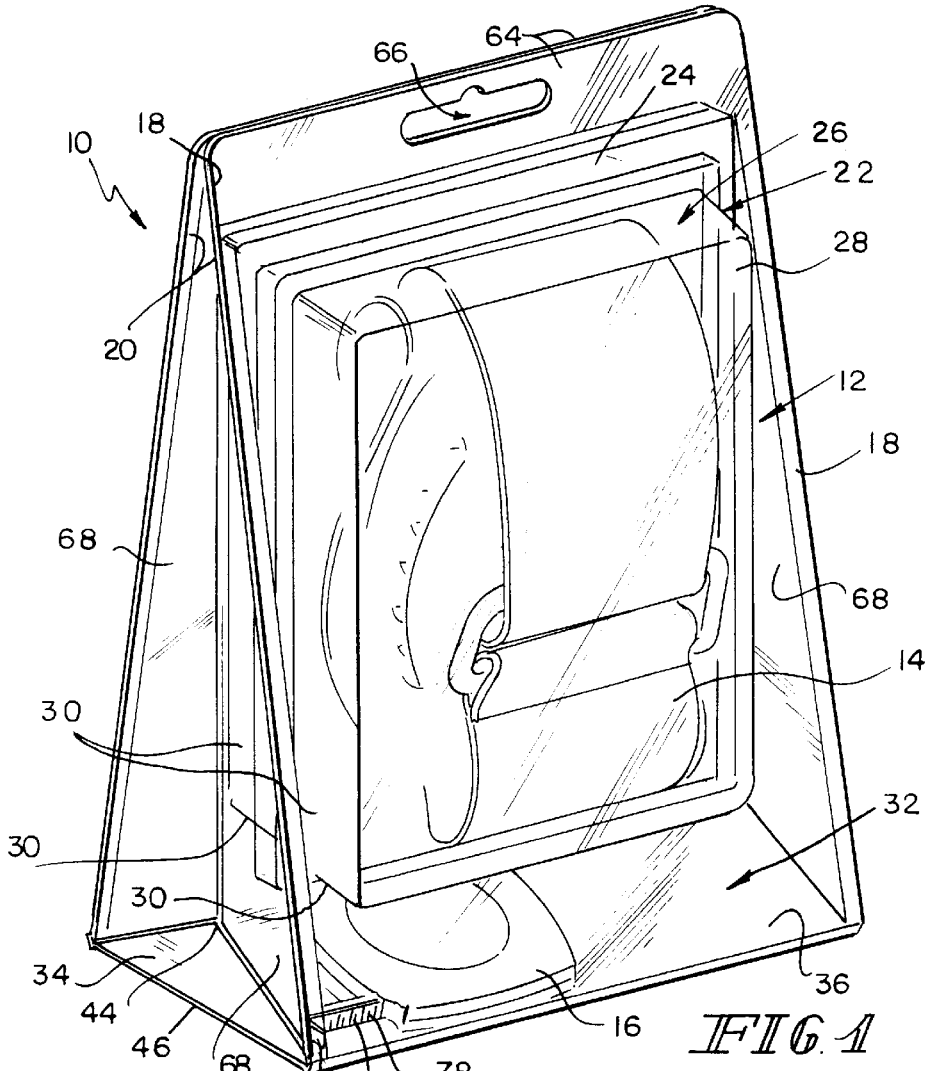
FIG. 1 is a perspective view of a preferred embodiment of the present invention illustrating a package comprising a container that defines a first chamber sized for housing a medical appliance and a second chamber housing a retractable tape measure whose tape is accessible to a consumer.

A package 10 in accordance with the present invention is shown in FIG. 1 as it would appear to a consumer at a retail store. The package 10 is configured to either stand upon a shelf (not shown), hang from a rack (not shown), or be stacked. The package 10 comprises a container 12 that houses a medical appliance 14, and carries a retractable measurement device 16. The measurement device 16 is positioned so that it is easily accessible to the consumer. Thus, the consumer can grasp the measurement device 16, assess a dimension of a preselected body part (not shown), and depending upon that dimension, determine whether the medical appliance 14 in the container 12 is the proper size for the consumer's needs. It is understood that a wide variety of appliances 14 may be held in the package 10 of the present invention. Non-limiting examples of appliances 14 include orthopaedic appliances for the wrists, ankles, elbows, knees, shoulders, thighs, necks, or any other device needing measurement. Moreover bandages for the arms, legs, hips, waist, chest, and head may be held in the container 12.

Beneficially, a package 10 in accordance with the present invention carries a retractable measurement device 16 that enables consumers to accurately measure themselves and to select a proper size of medical appliance 14 before purchasing the appliance 14 held within the package 10. Thus, inconveniences associated with returned merchandise and opened packaging are drastically reduced. The overall consumer satisfaction with the medical appliance 14 will increase when the proper size of the appliance is easily and quickly determined.

The container 12 is constructed of a foldable plastic material that may be optically transparent, opaque, or degrees therebetween. The container 12 is substantially transparent so that the consumer may view the medical appliance 14 or an appliance sheet (not shown) within the container 12. The container 12 includes an external surface 18 and an opposite internal surface 20. In addition, when the container 12 is folded, it typically takes on a triangular shape. The container 12 is formed to include a front clam shell 22 and an opposite back clam shell 24 that cooperate to define a first chamber 26 positioned between the folded internal surfaces 20 of the shells 22, 24. See FIG. 1. This chamber 26 is sized to hold the medical appliance 14. It is understood that the chamber 26 may be formed in a variety of sizes in order to hold various sizes and types of medical appliances 14.

Figure 2:
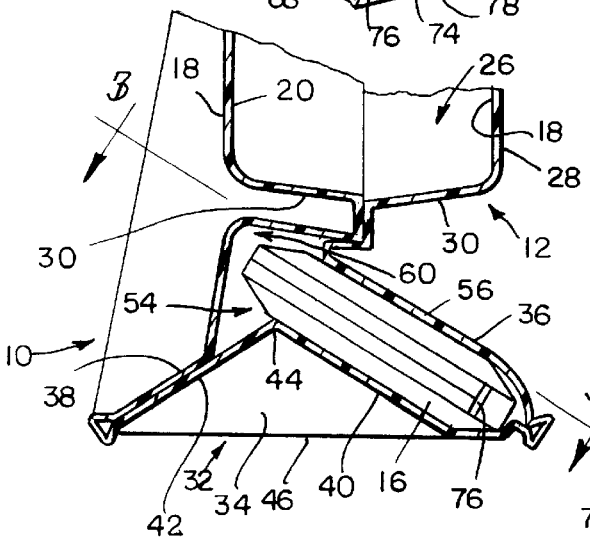
FIG. 2 is an enlarged sectional view of the package of FIG. 1, illustrating support walls in a folded cooperation to define the second chamber that houses the tape measure.

Each of the clam shells 22, 24 include an outer wall 28 and a rim 30 that extends about a circumference of the outer wall 28. In addition, the container 12 includes an accordion-style support surface 32 that extends between the rims 30 of the first and second clam shells 22, 24. The support surface 32 typically includes a triangular-shaped central base 34 and first and second sections 36, 38 extending from the base 34 as shown in FIG. 2. The central base 34 has angled side walls 40, 42 that converge to an apex 44 and a bottom wall 46 extending between the angled side walls 40, 42 opposite the apex 44. See FIGS. 1 and 2. The first and second sections 36, 38 are positioned at an angle of about 120° relative to one another when in the folded position and extend between the angled side walls 40, 42 of the central base 34 and the respective rims 30.

Referring to FIGS. 1 and 2, the central base 34 and the sections 36, 38 of the support surface 32 cooperate to form a second chamber 54 that is sized to accommodate and carry the measurement device 16. Particularly, the first section 36 of the support surface 32 includes a dome portion 56 and is folded upon the side wall 40 of the central base 34 in order to cover the measurement device 16. In addition, the apex 44 of the central base 34 is notched as shown in FIG. 2 to cooperate with the dome portion 56 of the first section 36 for placement of the measurement device 16 therebetween. The second section 38 of the support surface 32 is folded upon the side wall 42 of the central base 34 and includes a V-shaped crevice 60. This crevice 60 cooperates with the both the dome portion 56 and the notched central base 34 to form the second chamber 54. Moreover, the first side wall 40 of the central base 34 and the first section 36 of the support surface are 32 typically cooperate to form a channel 62 that extends between the second chamber 54 and the external surface 18 of the container 12. Thus, the package 10 of the present invention is preferably a one-piece foldable plastic container 12. When the plastic container 12 is folded, it provides a first chamber 26 sized to house the medical appliance and a second chamber 54 sized to house the measurement device 16 in a manner that makes the measurement device 16 assessable to the consumer. Thus, the package 10 of the present invention enables consumers to measure selected body parts and to choose appropriate appliances 14 without opening the packages 10 that hold the appliances 14.

Figure 4:
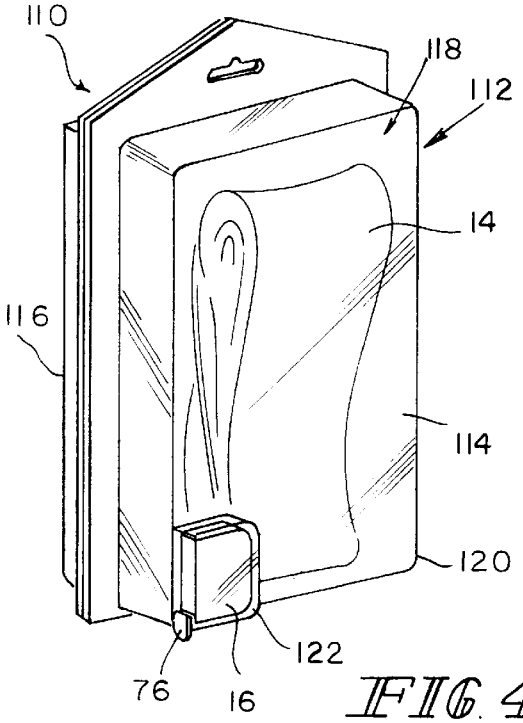
FIG. 4 is a view of an alternative embodiment of the present invention illustrating a package comprising a clam shell container defining a chamber that is sized for holding the medical appliance and a tape measure attached to an external surface of the container.
Figure 5:
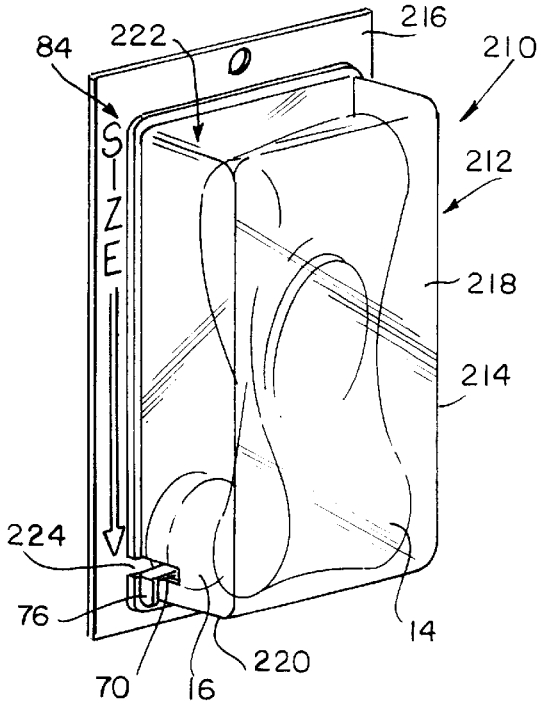
FIG. 5 is view of another alternative embodiment of the present invention, illustrating a card affixed to a blister pack that defines a chamber sized for holding a medical appliance and a tape measure positioned in the chamber such that one end of the tape extends through the blister pack for access by a consumer.

Referring again to FIG. 1, the container 12 further includes a top wall 64 that extends from each of the rims 30 opposite the support surface 32. Each of the top walls 64 include an aperture 66 having the characteristic "coat hanger" shape. See FIGS. 1 and 4. The "coat hanger" shape of the aperture 66 aids in suspending the container 12 on mounting pins (not shown). It is understood, however, that the top walls 64 may be formed as a die cut hole as shown in FIG. 5. Moreover, a reinforcement wall 68 extends along rims 30 of each of the clam shells 22, 24 between the top wall 64 and the respective first and second sections 36, 38 of the support surface 32. See FIG. 1.

Figure 3:
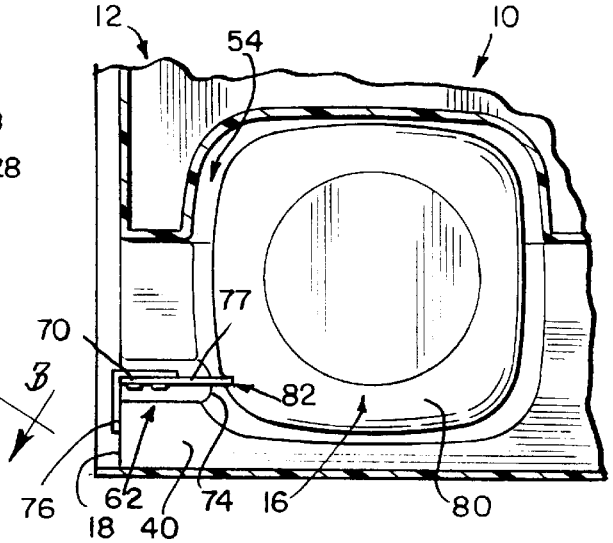
FIG. 3 is a view taken along lines 3—3 of FIG. 2, illustrating the tape measure resting in the second chamber and the tape extending through an outlet channel for access by a consumer.

The measurement device 16 of the present invention has a first end 70 accessible to the consumer, an opposite second end 72 (FIGS. 8 and 9), and a center portion 74 extending therebetween. As best shown in FIG. 3, a tab 76 is mounted on the first end 70 and is formed for engagement with the external surface 18 of the container 12. The center portion 74 extends from the second chamber 54 and through the channel 62. The tab 76 is positioned so that the first end 70 of the measurement device 16 is prevented from sliding through the channel 62 and into the second chamber 54.

The center portion 74 itself is sized for placement on the selected body part for measurement thereof. The center portion 74 is wrapped about body parts such as wrists, ankles, elbows, knees, shoulders, thighs, hips, waists, chests, necks, and heads. Moreover, the center portion 74 may be extended along a length of a body part such as the arm, leg, or midriff. The center portion 74 of the measurement device 16 is also formed to carry mensuration indicia 78 thereon. See FIG. 1. These indicia 78 may be spaced apart in pre-determined units such as inches or centimeters. It is understood, however, that the indicia 78 may be any units, including a manufacturer's own sizing scale (i.e. small, medium, large), color coded, or marked in a manner suitable to indicate to a consumer various measurements.

Preferably, the center portion 74 of the measurement device 16 is a pre-determined length of tape 77. This tape 77 is constructed of metal, cloth, plastic, or paper and is wound upon itself in overlapping convolutions in a roll. As shown in FIGS. 1–3, a housing 80 having a slot 82 surrounds the tape 77. A spring means (see for example FIGS. 8–9) is positioned with the housing 80 so that when the consumer pulls upon the first end 70, the center portion 74 is yieldably permitted to extend from the slot 82 in the housing 80 and away from the container 12. Upon releasing the first end 70 of the measurement device 16, this same spring means retracts the first end 70 toward the container 12. The spring automatically retracts the center portion 74 back toward the container 12 and into the housing 80. It is understood, however, that a tape grasping clutch (not shown) could be positioned within the housing 80 to permit the consumer to release the first end 70 without causing the center portion 74 to recoil into the housing 80. It is also understood that the measurement device 16 in accordance with the present invention may be selected from any one of a wide variety of commercially available tape measures. In addition, it is understood that the measurement device 16 could include a straight center portion having the compression spring (not shown) attached to the second end.

The package 10 of the present invention preferably includes instructional material 84. See for example FIG. 5. This material 84 indicates a relationship between the center portion 74 of the measurement device 16 and the container 12 that contains the medical appliance 14 best suited for the size of the consumer. The instructional material 84 may be positioned within the transparent front and back clam shells 22, 24, affixed on the external surface 18 of the container 12, or even positioned upon the center portion 74 of the measurement device 16. It is understood that the instructional material 84 may be written out in words, may be set forth numerically, or may even have a color code that coordinates the container 12 and the center portion 74 of the measurement device 16.

In an alternative embodiment of the present invention, a package 110 includes a container 112 that has opposite clam shell walls 114, 116 that cooperate when folded to define a chamber 118 sized to hold the medical appliance 14. See FIG. 4. The measurement device 16 is carried on an external surface 120 of the clam shell walls 114, 116. The device 16 is held in place by a flexible, transparent plastic membrane 122 adhered to the external surface 120 and referred to in the trade as a "shrink-wrap". It is understood that the measurement device 16 may be attached to the external surface 120 by an adhesive or by means of a transparent, semi-rigid cover adhered to the external surface 120 and referred to in the trade as a "blister pack".

Another alternative embodiment of the present invention is shown in FIG. 5. A package 210, is provided that includes a container 212 formed as a blister pack 214 adhered to a card 216. The blister pack 214 includes a front face 218 and a border 220 that extends between the front face 218 and the card 216. Illustratively, the blister pack 214 and the card 216 cooperate to form a chamber 222 sized to house both the medical appliance 14 and the measurement device 16. The measurement device 16 is typically fastened to the card 216 adjacent the border 220. It is understood that the measurement device 16 may be attached with adhesives, plastic shrink-wrap, hook and loop-type fasteners, and other suitable attachment means. In addition, the border 220 of the blister pack 214 includes a slot 224 therethrough. The slot 224 is positioned and sized for extension of the first end 70 of the tape 77 therethrough. The tab 76 normally engages the border 220.

Figure 6:
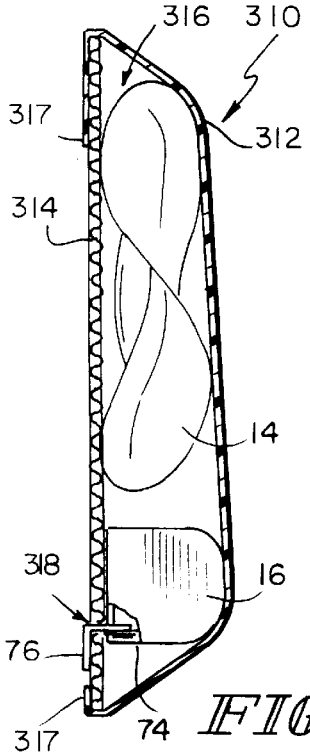
FIG. 6 is a view of yet another alternative embodiment of the present invention illustrating a card affixed to a blister pack defining a chamber sized for housing a medical appliance and a tape measure positioned in the chamber such that one end of the tape extends through the card for access by a consumer.

Yet another alternative embodiment is shown in FIG. 6. A package 310 includes a shrink wrap 312 attached to a card 314. The shrink wrap 312 includes opposite ends 317 that are wrapped about the card 314. The shrink wrap 312 and the card 314 cooperate to form a chamber 316 sized to hold both the medical appliance 14 and the measurement device 16. The card 314 itself is formed to include a notch 318 therethrough that is sized for extension of the center portion 74 of the tape 77 therethrough. The measurement device 16 is positioned within the chamber 316 in a manner that permits the center portion 74 of the tape 77 to extend through the notch 318 for access by the consumer.

Figure 7:
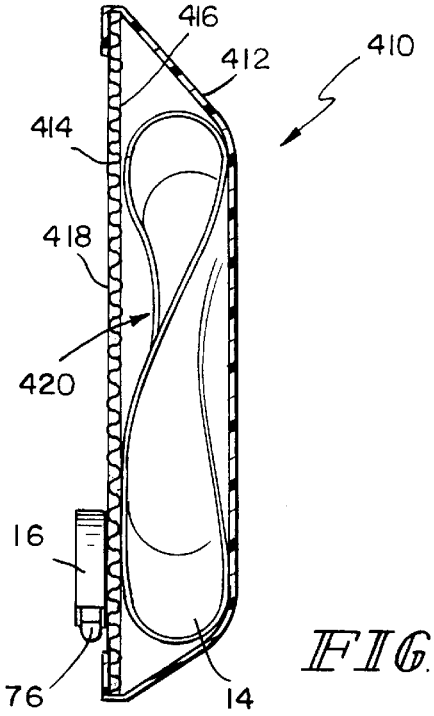
FIG. 7 is a view of yet another alternative embodiment of the present invention illustrating a card having an outer surface and an opposite inner surface affixed to a blister pack defining a chamber that is sized for holding a medical appliance and a tape measure affixed on the outer surface of the card for access by a consumer.

A further embodiment of the present invention is shown in FIG. 7. A package 410 includes a shrink wrap 412 attached to a card 414. The card 414 includes a front surface 416 and an opposite back surface 418. The front surface 416 of the card 414 and the shrink wrap 412 cooperate to form a chamber 420 sized to hold the medical appliance 14. The measurement device 16 is attached to the back surface 418 of the card 414. See FIG. 7. The measurement device 16 is attached to the back surface 418 with an adhesive. It is understood, however, that any of the above described attachment means may be used to attach the device 16 to the card 414.

Still another embodiment of the present invention is shown in FIGS. 8 and 9. A package 510 includes a shrink wrap 512 and a blister pack 514 affixed to a card 516. The card 516 typically includes a top portion 518 formed to include an aperture 520 therethrough, a bottom portion 522, and a center portion 524 extending therebetween. The shrink wrap 512 cooperates with the center portion 524 of the card 516 to form a first chamber 526 sized to hold the medical appliance 14.

The blister pack 514 cooperates with the bottom portion 522 of the card 516 to form a second chamber 528 sized to both securely hold and form a casing for the measurement device 16. See FIG. 8. In addition, the blister pack 514 extends across the bottom portion 522 of the card 516 to form a channel 530 for extension of the center portion 74 of the measurement device 16 therethrough. In addition, the blister pack 514 is formed to hold the second end 72 of the tape 77 is a secure and stationary position. See FIG. 9. The blister pack 514 itself includes a cover portion 532 and a locking portion 534 that extends toward the card 516. Typically, the card 516 includes a mounting portion 536 sized to receive the locking portion 534 of the blister pack 514. The spring 538 extends between the center portion 74 of the tape 77 and the locking portion 534 of the blister pack 514 to normally urge the center portion 74 in overlapping convolutions in a roll. See FIG. 9. Referring again to FIG. 8, the center portion 74 of the tape 77 extends through the channel 530 and the tab 76 engages the blister pack 514.

To use the package 10 of the present invention, the consumer first selects the medical appliance 14 appropriate for the intended use. Once selected, the consumer removes the package 10 from the rack and pulls the retractable tape 77 from the package 10 so that the center portion 74 of the tape 77 extends away from the container 12. See FIG. 8. The measurement device 16 is then used by the consumer to measure the body part that corresponds to the medical appliance 14. The consumer then compares the measurement with the container 12 to determine accurately whether the appliance 14 will correctly fit the consumer. After taking the measurement, the consumer must only release the center portion 74 of the tape 77 to initiate automatic retraction of the center portion 74 into the package 10.

Although the invention has been described in detail with reference to certain preferred embodiments, variations and modifications exist within the scope and spirit of the invention as described and defined in the following claims.

What is claimed is:

1. A package for a medical appliance that enables a consumer to measure a body part and select a proper size of the medical appliance, the package comprising a container formed to enclose the medical appliance, a measurement device carried by the container, the measurement device having a first end accessible to the consumer, an opposite second end, and a center portion extending therebetween, and a spring configured to yieldably permit extension of the first end of the measurement device away from the container and to retract the first end toward the container following extension thereof.

2. The package of claim 1, wherein the center portion of the measurement device carries mensuration indicia thereon.

3. The package of claim 2, further comprising instructions that indicate a relationship between the mensuration indicia and a size of the medical appliance.

4. The package of claim 1, wherein the measurement device is a length of tape and said tape is wound upon itself in overlapping convolutions.

5. The package of claim 4, wherein the spring is carried by the container.

6. The package of claim 1, wherein the container includes a front clam shell, a back clam shell, and a support surface extending between the front and back clam shells, and the front and back clam shells are formed to cooperate with one another in a folded position to define a chamber sized to house the medical appliance.

7. The package of claim 6, wherein the support surface includes a central base and opposite first and second sections extending from the central base toward the respective front and back clam shells, and the central base and opposite first and second sections are formed to cooperate with one another in a folded position to define a second chamber sized to house the measurement device.

8. The package of claim 7, wherein the central base includes angled side walls converging to an apex and the opposite first and second sections are positioned adjacent the angled side walls of the central base in the folded position.

9. The package of claim 7, wherein the central base and one of the opposite first and second sections cooperate to form a channel extending from the second chamber.

10. The package of claim 9, wherein the channel is sized for extension of the center portion of the measurement device therethrough.

11. The package of claim 7, wherein the first and second sections are positioned at an angle of about 120° relative to one another.

12. The package of claim 1, wherein the container includes an external surface and an opposite internal surface and the measurement device is carried on the external surface.

13. The package of claim 12, further comprising shrink wrap that extends over the measurement device and is attached to the container.

* * * * *